US010691052B2

(12) United States Patent
Shimizu et al.

(10) Patent No.: US 10,691,052 B2
(45) Date of Patent: Jun. 23, 2020

(54) IMAGE FORMING APPARATUS

(71) Applicant: KYOCERA Document Solutions Inc., Osaka-shi (JP)

(72) Inventors: Tamotsu Shimizu, Osaka (JP); Akifumi Yamaguchi, Osaka (JP); Yasuhiro Tauchi, Osaka (JP); Kenichi Tamaki, Osaka (JP); Koji Suenami, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/554,448

(22) Filed: Aug. 28, 2019

(65) Prior Publication Data

US 2020/0073308 A1 Mar. 5, 2020

(30) Foreign Application Priority Data

Aug. 31, 2018 (JP) ..... 2018-162705

(51) Int. Cl.
*G03G 15/00* (2006.01)

(52) U.S. Cl.
CPC ..... *G03G 15/5041* (2013.01); *G03G 15/5037* (2013.01); *G03G 2215/00037* (2013.01); *G03G 2215/00054* (2013.01)

(58) Field of Classification Search
None
See application file for complete search history.

(56) References Cited

U.S. PATENT DOCUMENTS 5,296,903 A * 3/1994 Suzuki ..... G03G 15/1645 399/66
2003/0219266 A1 11/2003 Itagaki et al.

FOREIGN PATENT DOCUMENTS

| | | |
|---|---|---|
| JP | 2003-345075 | 12/2003 |
| JP | 2004-37952 | 2/2004 |
| JP | 5024192 | 9/2012 |
| JP | 5273542 | 8/2013 |

* cited by examiner

*Primary Examiner* — Victor Verbitsky
(74) *Attorney, Agent, or Firm* — Gerald E. Hespos; Michael J. Porco; Matthew T. Hespos

(57) ABSTRACT

In the first charge amount acquisition operation, based on density of a plurality of toner images for measurement or based on a direct component of a developing current at the time of forming the plurality of toner images in addition to the density of the plurality of toner images for measurement, the charge amount acquisition section acquires a first toner charge amount that is a charge amount of toner included in the toner image for measurement. In the second charge amount acquisition operation, based on the toner density detected at the time of image formation and a relationship between the first toner charge amount and the toner density detected in the first charge amount acquisition operation, the charge amount acquisition section acquires a second toner charge amount that is a charge amount of the toner in the development device.

9 Claims, 13 Drawing Sheets

IMAGE FORMING APPARATUS

This application is based on Japanese Patent Application No. 2018-162705 filed on Aug. 31, 2018, the entire content of which is incorporated herein by reference.

BACKGROUND

Field of the Invention

The present invention relates to an image forming apparatus that forms an image on a sheet.

Related Art

Conventionally, an image forming apparatus including a photosensitive drum (image carrier), a development device having a developing roller, and a transfer member has been known as an image forming apparatus that forms an image on a sheet. When an electrostatic latent image formed on the photosensitive drum is visualized in a development nip by the development device, a toner image is formed on the photosensitive drum. The toner image is then transferred to a sheet by the transfer member. A two-component developing technique in which a developer containing toner and carrier is used has been known as a development device used for the image forming apparatus.

A technique of accurately measuring a toner charge amount has been conventionally proposed in the two-component developing technique described above. In this technique, a surface potential of the photosensitive drum before development and a surface potential of a toner layer on the photosensitive drum after development are measured. In addition, the toner developing amount is calculated from a measurement result of the image density of the developed toner layer. The toner charge amount is then calculated from the measured surface potentials and the toner developing amount.

In the technique described above, a current value flowing into the developing roller carrying the developer is measured. The measured current value is assumed to be the electric charge amount of toner moving from the developing roller to the photosensitive drum. The toner developing amount is calculated from the measurement result of the image density of the developed toner layer. The toner charge amount is then calculated from the electric charge amount of toner and the toner developing amount.

SUMMARY

An image forming apparatus according to an aspect of the present disclosure includes an image carrier, a charging device, an exposure device, a development device, a transfer section, a developing bias application section, an image density detector, a toner density detector, and a charge amount acquisition section. The image carrier is rotated to form an electrostatic latent image on a surface and carries a toner image obtained by visualizing the electrostatic latent image. The charging device charges the image carrier to a predetermined charging potential. The exposure device is disposed on a downstream side of the charging device in a rotating direction of the image carrier and exposes the surface of the image carrier charged to the predetermined charging potential with light according to predetermined image information to form the electrostatic latent image. The development device is disposed to oppose the image carrier at a predetermined development nip disposed on a downstream side of the exposure device in the rotating direction and includes a developing roller that is rotated to carry a developer formed of toner and carrier on a circumferential surface and supplies toner to the image carrier to form the toner image. The transfer section transfers the toner image carried on the image carrier to a sheet. The developing bias application section is capable of applying a developing bias having an alternating voltage superimposed on a direct voltage to the developing roller. The image density detector detects density of the toner image. The toner density detector detects toner density that is density of the toner in the developer in the development device. The charge amount acquisition section is capable of performing a first charge amount acquisition operation and a second charge amount acquisition operation each of which acquires a toner charge amount.

In the first charge amount acquisition operation, during a non-image forming operation in which an image forming operation of forming the toner image on the sheet is not performed, the charge amount acquisition section forms a plurality of toner images for measurement with different toner developing amounts on the image carrier, and based on density of the plurality of toner images for measurement detected by the image density detector or based on a direct component of a developing current flowing between the developing roller and the developing bias application section at the time of forming the plurality of toner images for measurement in addition to the density of the plurality of toner images for measurement, the charge amount acquisition section acquires a first toner charge amount that is a charge amount of toner included in the toner image for measurement formed on the image carrier.

In the second charge amount acquisition operation, at least during the image forming operation, based on the toner density detected by the toner density detector and a relationship between the first toner charge amount acquired in the first charge amount acquisition operation and the toner density detected by the toner density detector in the first charge amount acquisition operation, the charge amount acquisition section acquires a second toner charge amount that is a charge amount of the toner in the developer in the development device.

DETAILED DESCRIPTION

An image forming apparatus 10 according to an embodiment of the present invention will be described in detail below with reference to the drawings. The present embodiment illustrates a tandem color printer as an example of an image forming apparatus. The image forming apparatus may be, for example, a copying machine, a facsimile device, and a multifunction machine of the copying machine and the facsimile device. In addition, the image forming apparatus may be an apparatus that forms a single color (monochrome) image.

Figure 1:
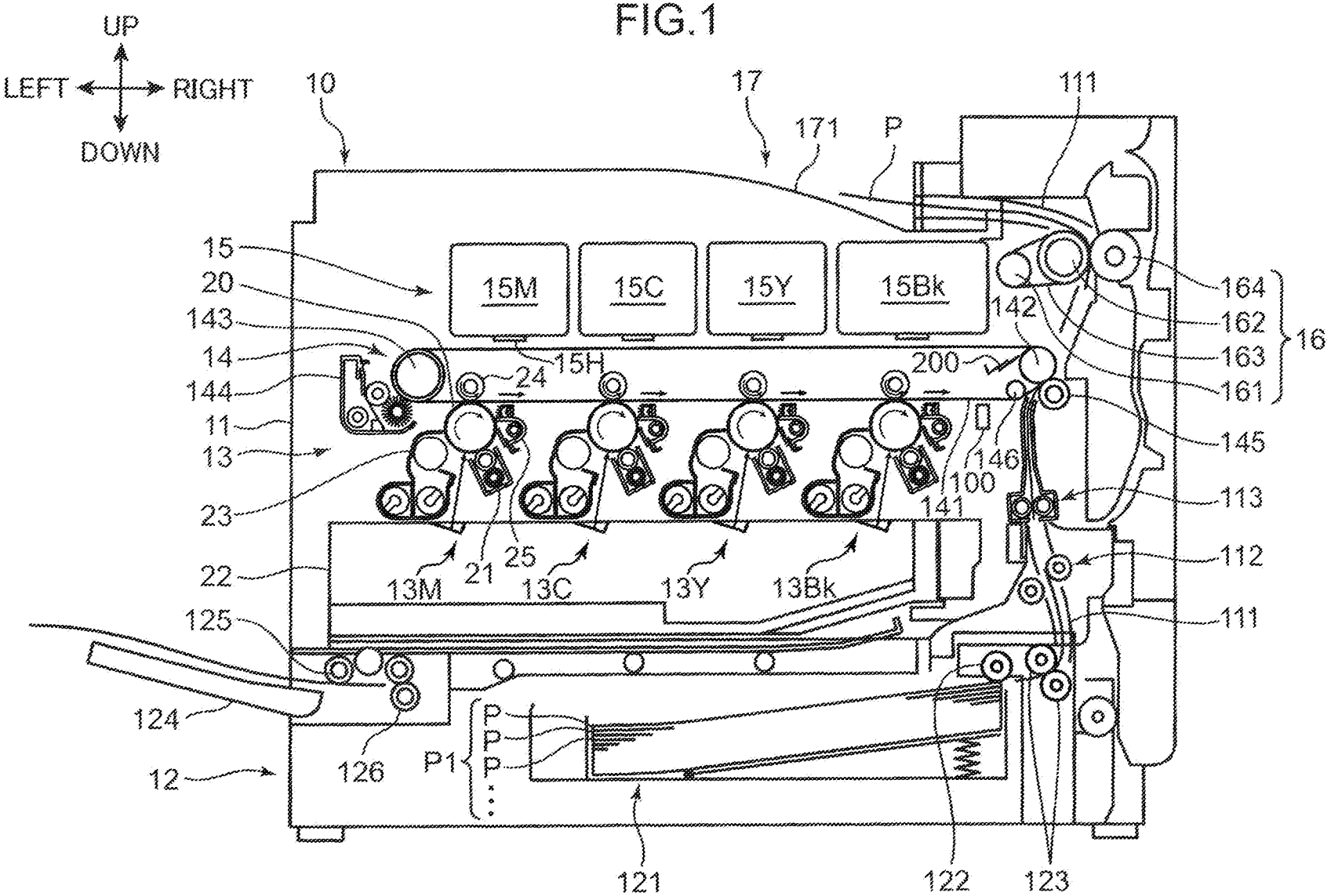
FIG. 1 is a cross-sectional view of an internal configuration of an image forming apparatus according to an embodiment of the present invention.

FIG. 1 is a cross-sectional view of an internal configuration of the image forming apparatus 10. The image forming apparatus 10 includes an apparatus main body 11 with a box-shaped housing structure. The apparatus main body 11 houses a feeder section 12 that feeds a sheet P, an image forming section 13 that forms a toner image to be transferred to the sheet P fed from the feeder section 12, an intermediate transfer unit 14 (transfer section) to which the toner image is primarily transferred, a toner replenishing section 15 that replenishes toner to the image forming section 13, and a fixing section 16 that fixes an unfixed toner image formed on the sheet P onto the sheet P. A sheet discharge section 17 in which the sheet P subjected to the fixing process by the fixing section 16 is discharged is disposed at the top of the apparatus main body 11.

An operation panel (not illustrated) for inputting output conditions of the sheet P is disposed at an appropriate position on the top surface of the apparatus main body 11. The operation panel includes a power supply key, touch panels for inputting the output conditions, and various types of operation keys.

In the apparatus main body 11, a sheet conveying path 111 extends vertically on the right side of the image forming section 13. The sheet conveying path 111 includes a conveying roller pair 112 that conveys a sheet to an appropriate position. A registration roller pair 113 that performs skew correction on a sheet and feeds a sheet to a secondary transfer nip to be described later at a predetermined timing is disposed on the upstream side of the nip in the sheet conveying path 111. The sheet conveying path 111 conveys the sheet P from the feeder section 12 through the image forming section 13 and the fixing section 16 to the sheet discharge section 17.

The feeder section 12 includes a feeder tray 121, a pickup roller 122, and a feed roller pair 123. The feeder tray 121 is attached to the bottom part of the apparatus main body 11 to be inserted into or removed from the apparatus main body 11, and stores a sheet bundle P1 in which a plurality of sheets P are stacked. The pickup roller 122 sends out the sheet P on the top of the sheet bundle P1 stored in the feeder tray 121 one by one. The feed roller pair 123 feeds the sheet P sent out by the pickup roller 122 to the sheet conveying path 111.

The feeder section 12 includes a manual bypass feeder section that is attached to the left side surface of the apparatus main body 11 illustrated in FIG. 1. The manual bypass feeder section includes a manual bypass tray 124, a pickup roller 125, and a feed roller pair 126. The manual bypass tray 124 is a tray in which a sheet P to be manually fed is placed, and is opened to the side surface of the apparatus main body 11 when the sheet P is manually fed as illustrated in FIG. 1. The pickup roller 125 sends out the sheet P placed in the manual bypass tray 124. The feed roller pair 126 feeds the sheet P sent out by the pickup roller 125 to the sheet conveying path 111.

The image forming section 13 forms a toner image to be transferred to the sheet P and includes a plurality of image forming units forming toner images with different colors. As such image forming units, in the present embodiment, a magenta unit 13M using a magenta (M) developer, a cyan unit 13C using a cyan (C) developer, a yellow unit 13Y using a yellow (Y) developer, and a black unit 13Bk using a black (Bk) developer are successively disposed from the upstream side to the downstream side (from the left side to the right side in FIG. 1) in a rotating direction of an intermediate transfer belt 141 to be described later. Each of the units 13M, 13C, 13Y, and 13Bk includes a photosensitive drum 20 (image carrier), and a charging device 21, a development device 23, a primary transfer roller 24, and a cleaning device 25 that are disposed around the photosensitive drum 20. An exposure device 22 shared by the units 13M, 13C, 13Y, and 13Bk is disposed below the image forming units.

The photosensitive drum 20 is driven to rotate around its axis, so that an electrostatic latent image is formed on the surface of the photosensitive drum 20 and a toner image obtained by visualizing the electrostatic latent image is carried on the surface. For example, a well-known amorphous silicon ($\alpha$-Si) photosensitive drum or a well-known organic (OPC) photosensitive drum is used as the photosensitive drum 20. The charging device 21 uniformly charges the surface of the photosensitive drum 20 to a predetermined charging potential. The charging device 21 includes a charging roller and a charging cleaning brush that removes toner attached onto the charging roller. The exposure device 22 is disposed on the downstream side of the charging device 21 in the rotating direction of the photosensitive drum 20. The exposure device 22 includes various optical system devices including a light source, a polygon mirror, a reflection mirror, and a deflection mirror. The exposure device 22 irradiates light modulated based on image data (predetermined image information) onto the surface of the photosensitive drum 20 uniformly charged to the predetermined charging potential to perform exposure, thus forming an electrostatic latent image.

The development device 23 is disposed to oppose the photosensitive drum 20 at a predetermined development nip NP (FIG. 3A) on the downstream side of the exposure device 22 in the rotating direction of the photosensitive drum 20.

The development device 23 includes a developing roller 231 that rotates to carry a developer formed of toner and carrier on its circumferential surface and supplies toner to the photosensitive drum 20, thereby forming the toner image.

The primary transfer roller 24 forms a nip with the photosensitive drum 20 with the intermediate transfer belt 141 included in the intermediate transfer unit 14 being interposed therebetween. In addition, the primary transfer roller 24 primarily transfers a toner image on the photosensitive drum 20 to the intermediate transfer belt 141. The cleaning device 25 cleans the circumferential surface of the photosensitive drum 20 after the transfer of the toner image.

The intermediate transfer unit 14 is disposed in a space between the image forming section 13 and the toner replenishing section 15, and includes the intermediate transfer belt 141, a drive roller 142 rotatably supported by a unit frame (not illustrated), a driven roller 143, a backup roller 146, and a density sensor 100. The intermediate transfer belt 141 is an endless belt-shaped rotator, and extends between the drive roller 142 and the driven rollers 143 and 146 so that the circumferential surface side abuts against the circumferential surface of each photosensitive drum 20. The intermediate transfer belt 141 is driven to revolve by the rotation of the drive roller 142. A belt cleaning device 144 is disposed near the driven roller 143 to remove toner remaining on the circumferential surface of the intermediate transfer belt 141. The density sensor 100 (image density detector) is disposed to oppose the intermediate transfer belt 141 on the downstream side of the units 13M, 13C, 13Y, and 13Bk. The density sensor 100 detects the density of a toner image formed on the intermediate transfer belt 141. In other embodiments, the density sensor 100 may detect the density of a toner image on the photosensitive drum 20 or may detect the density of a toner image fixed on the sheet P.

A secondary transfer roller 145 is disposed outside the intermediate transfer belt 141 to oppose the drive roller 142. The secondary transfer roller 145 press-contacts the circumferential surface of the intermediate transfer belt 141 to form a transfer nip with the drive roller 142. A toner image primarily transferred onto the intermediate transfer belt 141 is secondarily transferred to the sheet P supplied from the feeder section 12 at the transfer nip. That is, the intermediate transfer unit 14 and the secondary transfer roller 145 function as a transfer section that transfers a toner image carried on each photosensitive drum 20 to the sheet P. The drive roller 142 includes a roll cleaner 200 to clean the circumferential surface of the drive roller 142.

The toner replenishing section 15 stores toner used for image formation and includes a magenta toner container 15M, a cyan toner container 15C, a yellow toner container 15Y, and a black toner container 15Bk in the present embodiment. These toner containers 15M, 15C, 15Y, and 15Bk store replenishing toner of the respective colors M/C/Y/Bk. The toner of the respective colors M/C/Y/Bk is replenished to the respective development devices 23 in the image forming units 13M, 13C, 13Y, and 13Bk from a toner discharge port 15H formed at the bottom of each container.

The fixing section 16 includes a heating roller 161 including a heating source therein, a fixing roller 162 that is disposed to oppose the heating roller 161, a fixing belt 163 extending between the fixing roller 162 and the heating roller 161, and a pressing roller 164 that is disposed to oppose the fixing roller 162 with the fixing belt 163 being interposed therebetween and forms a fixing nip with these rollers. The sheet P supplied to the fixing section 16 passes through the fixing nip to be heated and pressed. The toner image transferred to the sheet P at the transfer nip is thus fixed on the sheet P.

The sheet discharge section 17 is formed by making a recess in the top part of the apparatus main body 11. A sheet discharge tray 171 is formed in the recess to receive the sheet P discharged to the bottom of the recess. The sheet P subjected to the fixing process passes through the sheet conveying path 111 extending from the top part of the fixing section 16 to be discharged to the sheet discharge tray 171.

<Development Device>

Figure 2:
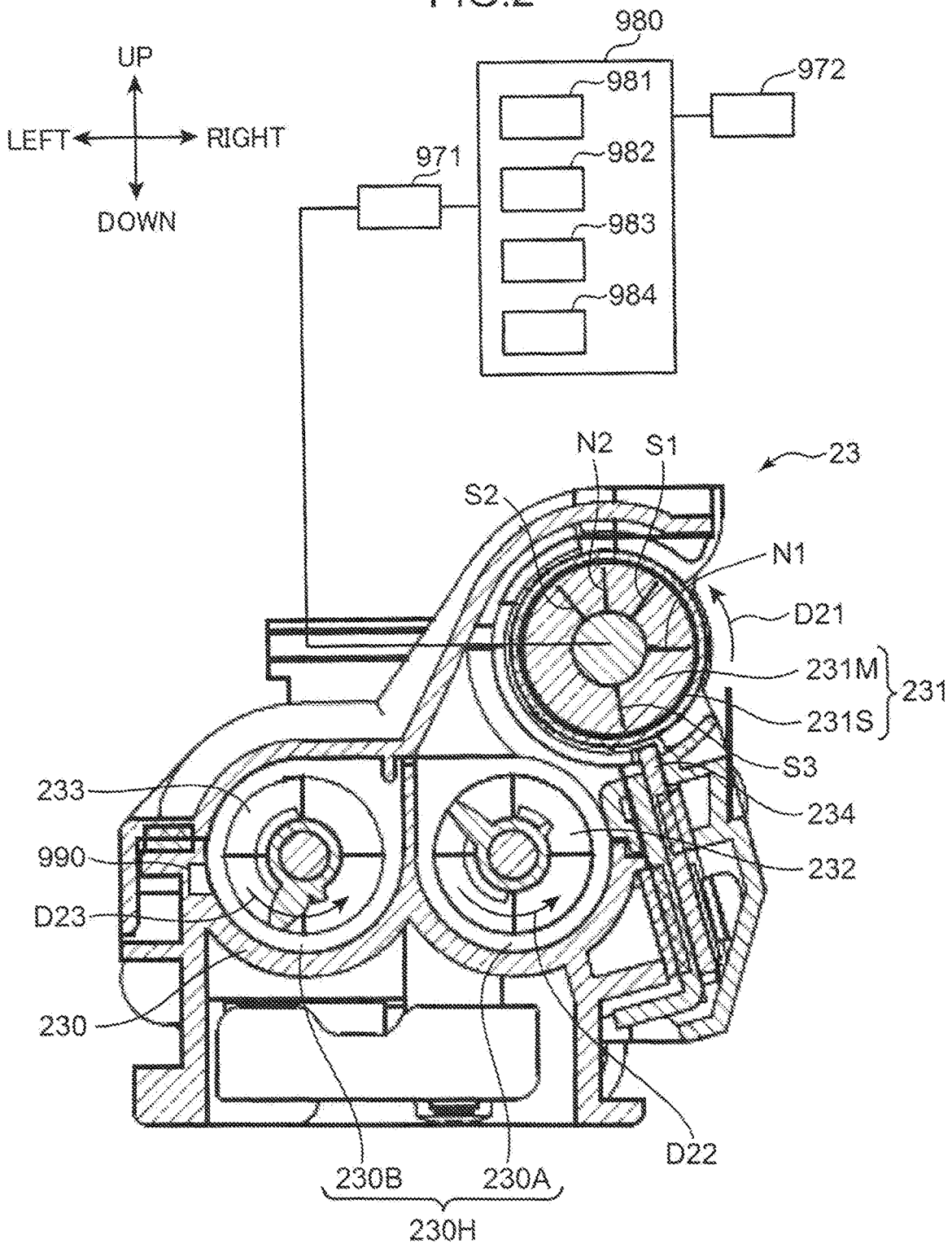
FIG. 2 illustrates a cross-sectional view of a development device and a block diagram of an electric configuration of a controller, according to an embodiment of the present invention.

FIG. 2 illustrates a cross-sectional view of the development device 23 and a block diagram of an electric configuration of a controller 980 according to the present embodiment. The development device 23 includes a development housing 230, the developing roller 231, a first screw feeder 232, a second screw feeder 233, a regulating blade 234, and a toner sensor 990 (toner density detector). A two-component developing method is used in the development device 23.

The development housing 230 includes a developer accommodating section 230H. A two-component developer formed of toner and carrier is accommodated in the developer accommodating section 230H. The developer accommodating section 230H includes a first conveying section 230A and a second conveying section 230B. In the first conveying section 230A, the developer is conveyed in a first conveying direction directed from one end side to the other end side in an axial direction of the developing roller 231 (a direction perpendicular to the drawing of FIG. 2 and extending from back to front). The second conveying section 230B communicates with the first conveying section 230A at both ends in the axial direction. In the second conveying section 230B, the developer is conveyed in a second conveying direction opposite to the first conveying direction. The first screw feeder 232 is rotated in a direction of an arrow D22 and the second screw feeder 233 is rotated in a direction of an arrow D23 in FIG. 2, thus conveying the developer in the first conveying direction and the second conveying direction, respectively. In particular, the first screw feeder 232 supplies the developer to the developing roller 231 while conveying the developer in the first conveying direction.

Figure 3A:
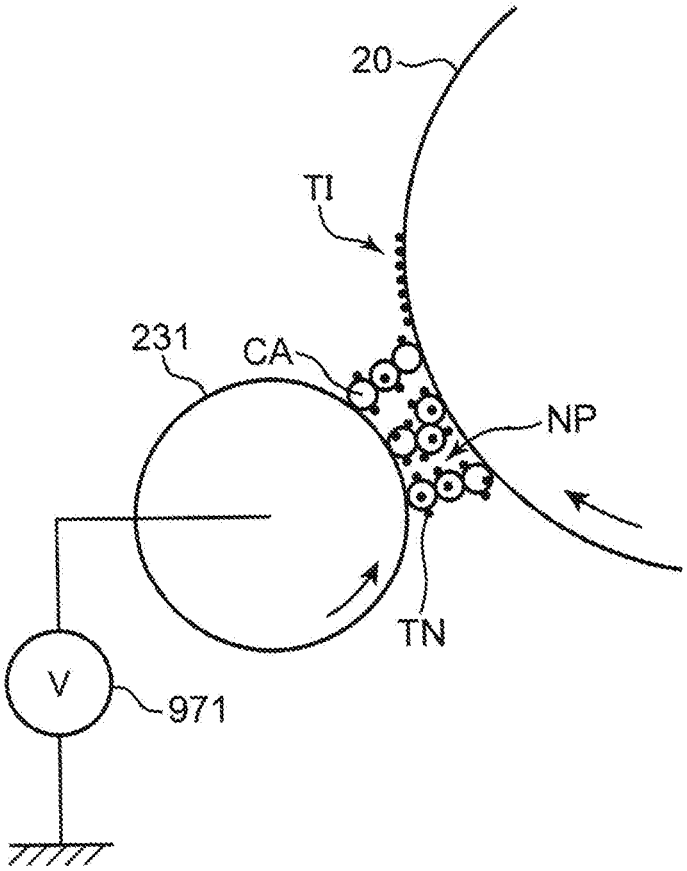
FIG. 3A is a schematic view illustrating a development operation of the image forming apparatus according to an embodiment of the present invention.

The developing roller 231 is disposed to oppose the photosensitive drum 20 at the development nip NP (FIG. 3A). The developing roller 231 includes a rotating sleeve 231S and a magnet 231M disposed in the sleeve 231S in a fixed manner. The magnet 231M includes an S1 pole, an N1 pole, an S2 pole, an N2 pole, and an S3 pole. The N1 pole functions as a main pole, the S1 pole and the N2 pole function as conveying poles, and the S2 pole functions as a peeling pole. The S3 pole functions as both a pumping pole and a regulating pole. For example, the magnetic flux density of the S1 pole, the N1 pole, the S2 pole, the N2 pole, and the S3 pole is set to 54 mT, 96 mT, 35 mT, 44 mT, and 45 mT, respectively. The sleeve 231S of the developing roller 231 is rotated in a direction of an arrow D21 of FIG. 2. The developing roller 231 is rotated to receive the developer in the development housing 230, carry a developer layer, and supply toner to the photosensitive drum 20. In the present embodiment, the developing roller 231 rotates in the same direction (width direction) as the photosensitive drum 20 at the position where the developing roller 231 opposes the photosensitive drum 20.

The regulating blade 234 (layer-thickness regulating member) is disposed at a predetermined distance from the developing roller 231 and regulates the layer thickness of the developer supplied from the first screw feeder 232 onto the circumferential surface of the developing roller 231.

The toner sensor 990 is fixed in the development housing 230. The toner sensor 990 detects toner density (% by weight), that is, the density of toner in the developer in the development device 23. In the present embodiment, the toner density is obtained by multiplying a value calculated by dividing the weight of toner by the weight of carrier by 100.

The image forming apparatus 10 including the development device 23 also has a developing bias application section 971, a drive section 972, and the controller 980. The controller 980 is constituted by a CPU (Central Processing Unit), a ROM (Read Only Memory) that stores a control program, a RAM (Random Access Memory) used as the work area of the CPU, and other components.

The developing bias application section 971 is constituted by a direct power supply and an alternating power supply, and applies a developing bias having an alternating voltage superimposed on a direct voltage to the developing roller 231 of the development device 23 based on a control signal from a bias controller 982 to be described later.

The drive section 972 is constituted by a motor and a gear mechanism transmitting the torque of the motor. The drive section 972 drives the developing roller 231, the first screw feeder 232, and the second screw feeder 233 in the development device 23 to rotate in addition to the photosensitive drum 20, in response to a control signal from a drive controller 981 to be described later during a development operation (image forming operation), a charge amount measurement mode, and calibration. The drive section 972 also generates drive force for driving (rotating) other members in the image forming apparatus 10.

The controller 980 functions to include the drive controller 981, the bias controller 982, a storage 983, a mode controller 984 (charge amount acquisition section, charge amount adjustment section), and a replenishment controller 985 by the CPU executing the control program stored in the ROM.

The drive controller 981 controls the drive section 972 to drive the developing roller 231, the first screw feeder 232, and the second screw feeder 233 to rotate. The drive controller 981 also controls a drive mechanism (not illustrated) to drive the photosensitive drum 20 to rotate.

The bias controller 982 controls the developing bias application section 971 during the development operation of supplying toner from the developing roller 231 to the photosensitive drum 20 to apply a potential difference including a direct voltage and an alternating voltage between the photosensitive drum 20 and the developing roller 231. The potential difference moves toner from the developing roller 231 to the photosensitive drum 20.

The storage 983 stores various information referred to by the drive controller 981, the bias controller 982 and the mode controller 984. For example, the number of rotations of the developing roller 231 and a developing bias value adjusted depending on the environment are stored in the storage 983. The storage 983 also previously stores reference information about the slope of a straight line for reference illustrating the relationship between a change in the density of a toner image and a change in frequency when the frequency of an alternating voltage of a developing bias changes while the potential difference in direct voltage between the developing roller 231 and the photosensitive drum 20 is maintained constant, for each value of the toner charge amount. The reference information stored in the storage 983 is set to have a negative slope of the straight line for reference when the toner charge amount is a first charge amount and have a positive slope of the straight line for reference when the toner charge amount is a second charge amount less than the first charge amount. In addition, the reference information is set so that the slope of the straight line for reference increases as the toner charge amount decreases. Date stored in the storage 983 may be graphs and tables.

The mode controller 984 performs a charge amount measurement mode (first charge amount acquisition operation) and a real-time charge amount acquisition operation (second charge amount acquisition operation) in which each value of the toner charge amount is acquired, which will be described later.

The mode controller 984 performs the charge amount measurement mode of acquiring the first toner charge amount that is the charge amount of toner included in the toner image for measurement formed on the photosensitive drum 20 based on the density of the plurality of toner images for measurement detected by the density sensor 100 or based on a direct component of a developing current flowing between the developing roller 231 and the developing bias application section 971 when the plurality of toner images for measurement are formed, in addition to the density of the plurality of toner images for measurement after the mode controller 984 controls the charging device 21, the exposure device 22, and the developing bias application section 971 during a non-image forming operation in which an image forming operation of forming a toner image on a sheet P is not performed to form a plurality of toner images for measurement with different toner developing amounts on the photosensitive drum 20. In addition, the mode controller 984.

Specifically, in the charge amount measurement mode, the mode controller 984 forms the plurality of toner images for measurement on the photosensitive drum 20 by changing the frequency of the alternating voltage of the developing bias while maintaining constant the difference in the potential of a direct voltage between the developing roller 231 and the photosensitive drum 20. The mode controller 984 then acquires the slope of a straight line for measurement illustrating the relationship between a change in the density of the toner images for measurement and a change in the frequency from the change in the frequency and detection results of the density of the toner images for measurement by the density sensor 100. The mode controller 984 also acquires the charge amount (first toner charge amount) of toner included in the toner images for measurement formed on the photosensitive drum 20 from the acquired slope of the straight line for measurement and the reference information in the storage 983.

In the real-time charge amount acquisition operation, the mode controller 984 acquires the second toner charge amount that is the charge amount of toner in the developer in the development device 23 at least during the image forming operation based on the toner density detected by the toner sensor 990 in real time and the relationship between the toner charge amount acquired in the past charge amount measurement mode and the toner density detected by the density sensor 100. In this case, as described later, assuming that the first toner charge amount is denoted by TV1 (μc/g), the toner density detected by the toner sensor 990 in the charge amount measurement mode is denoted by TC1 (%), the second toner charge amount is denoted by TV2 (μc/g), and the toner density detected by the toner sensor 990 in the real-time charge amount measurement operation is denoted by TC2 (%), the mode controller 984 determines constants a and b satisfying 1/TV1=a×TC1+b and acquires the second toner charge amount based on the relationship between the determined a and b and the detected toner density TC2, and TV2=1/(a×TC2+b).

In addition, the mode controller 984 functions as a charge amount adjustment section to adjust the charge amount of toner in the development device 23 based on the first toner charge amount or second toner charge amount acquired as described above. When the first toner charge amount or the second toner charge amount is higher than a previously set threshold, the mode controller 984 causes the toner replenishing section 15 to replenish the replenishing toner to the development device 23, thus increasing the density of toner in the developer in the development device 23 and adjusting the toner charge amount.

The replenishment controller 985 controls a replenishing operation in which the toner replenishing section 15 replenishes the replenishing toner to the development device 23 according to the image forming operation of the image forming apparatus 10 so that the toner density detected by the toner sensor 990 is included in a previously set target toner density range (between an upper limit value and a lower limit value). When the first toner charge amount or the second toner charge amount is lower than the threshold, the mode controller 984 changes the target toner density range to acquire a lower target toner density range.

<Development Operation>

Figure 3B:
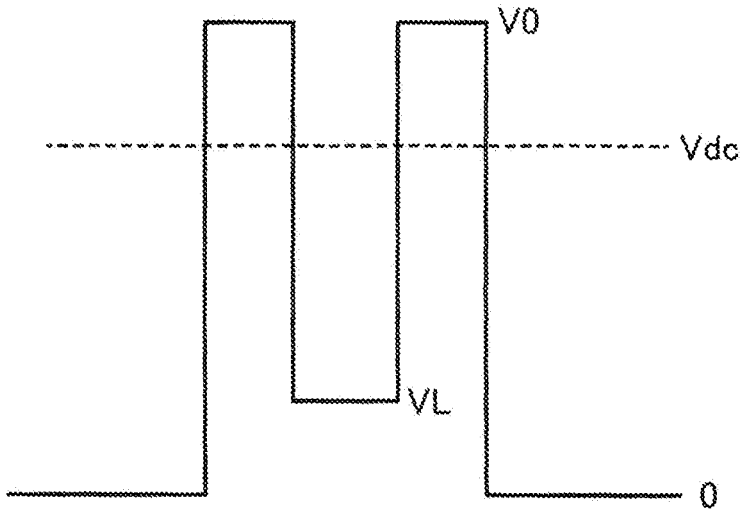
FIG. 3B is a schematic view illustrating a magnitude relationship between a potential of an image carrier and a potential of a developing roller, according to an embodiment of the present invention.

FIG. 3A is a schematic view illustrating a development operation of the image forming apparatus 10 according to the present embodiment. FIG. 3B is a schematic view illustrating a magnitude relationship between the potential of the photosensitive drum 20 and the potential of the developing roller 231. Referring to FIG. 3A, the development nip NP is formed between the developing roller 231 and the photosensitive drum 20. Toner TN and carrier CA carried on the developing roller 231 form a magnetic brush. At the development nip NP, the toner TN is supplied from the magnetic brush to the side of the photosensitive drum 20, so that a toner image TI is formed. Referring to FIG. 3B, the surface potential of the photosensitive drum 20 is charged to a background potential V0 (V) by the charging device 21. Thereafter, when the exposure device 22 irradiates exposure light onto the photosensitive drum 20, the surface potential of the photosensitive drum 20 changes from the background potential V0 up to an image portion potential VL (V) according to an image to be printed. Meanwhile, a direct voltage Vdc of a developing bias is applied to the developing roller 231 and an alternating voltage (not illustrated) is superimposed on the direct voltage Vdc.

In such a reversal development method, the potential difference between the surface potential V0 and the direct component Vdc of a developing bias is a potential difference for preventing toner from fogging on the background portion on the photosensitive drum 20. The potential difference between the surface potential VL after exposure and the direct component Vdc of a developing bias is a development potential difference for moving positive toner to the image portion on the photosensitive drum 20. With the alternating voltage applied to the developing roller 231, the movement of toner from the developing roller 231 to the photosensitive drum 20 is accelerated.

While circulated and conveyed in the development housing 230, the toner is frictionally charged by carrier. Each value of the toner charge amount affects the amount of toner (development amount) moving to the side of the photosensitive drum 20 by the developing bias. Consequently, if the toner charge amount can be estimated accurately in the image forming apparatus 10, by adjusting the developing bias and the toner density according to the number of prints, environmental variations, a print mode, and a coverage rate, excellent image quality can be kept. For this reason, it has been conventionally required to estimate the toner charge amount accurately.

<Estimation of Toner Charge Amount>

As the result of diligent study in view of the above situation, the present inventors have found that when the frequency of an alternating voltage of a developing bias changes, a toner developing amount varies depending on a toner charge amount. Specifically, the present inventors have found the following. In a case where the toner charge amount is low, if the frequency of the alternating voltage increases, the toner developing amount increases accordingly. On the other hand, in a case where the toner charge amount is high, if the frequency of the alternating voltage increases, the toner developing amount decreases. By measuring a change in image density with respect to a changing frequency of the alternating voltage using such characteristics, the toner charge amount can be estimated accurately.

Figure 4:
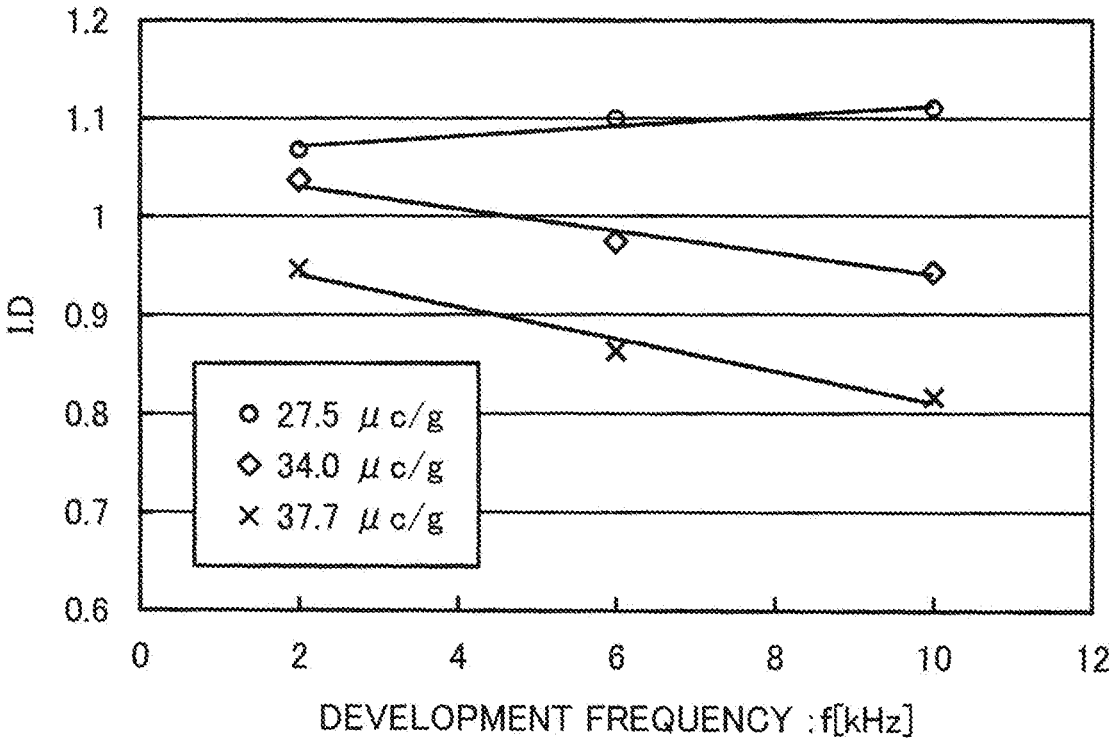
FIG. 4 is a graph illustrating a relationship between a frequency of a developing bias and image density in the image forming apparatus according to an embodiment of the present invention.
Figure 5:
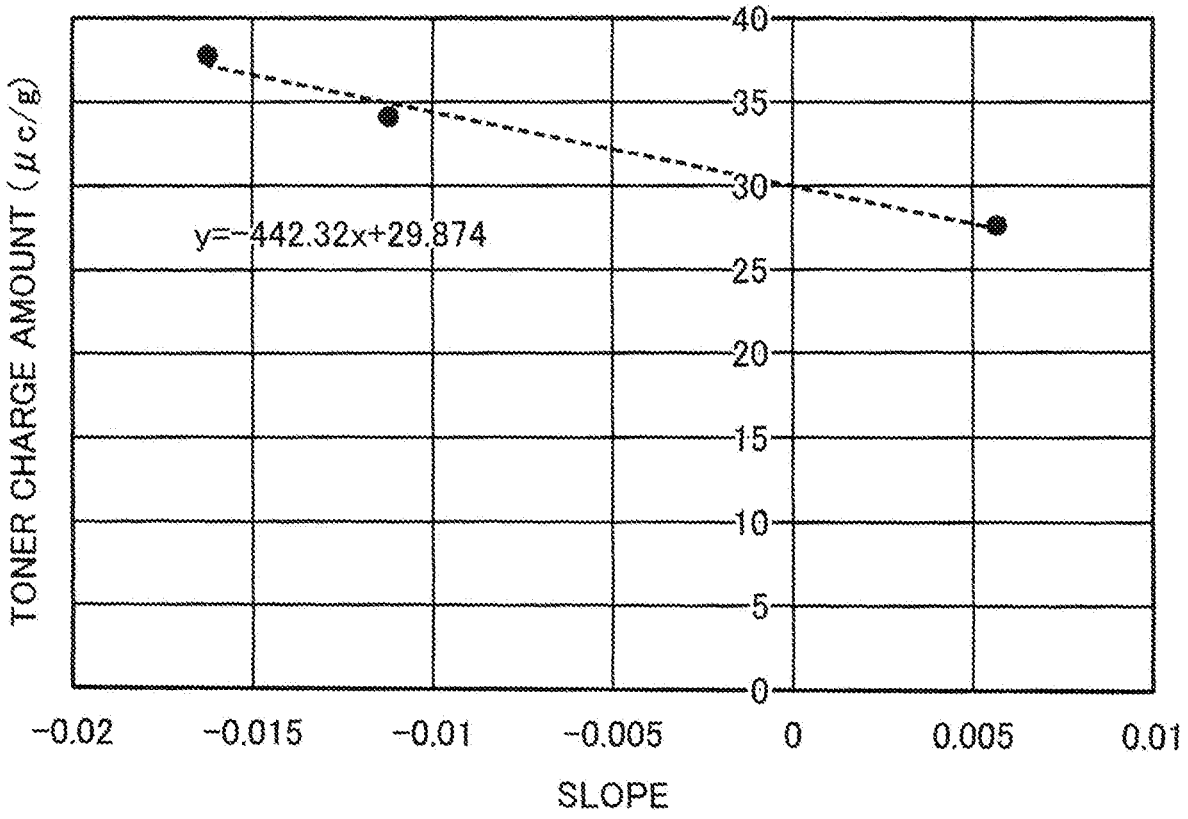
FIG. 5 is a graph illustrating a relationship between a slope of the graph of FIG. 4 and a toner charge amount in the image forming apparatus according to an embodiment of the present invention.

FIG. 4 is a graph illustrating a relationship between the frequency of a developing bias and image density in the image forming apparatus 10 according to the present embodiment. FIG. 5 is a graph illustrating a relationship between the slope of the graph illustrated in FIG. 4 and a toner charge amount in the image forming apparatus 10 according to the present embodiment.

While the potential difference between a direct voltage of a developing bias applied to the developing roller 231 and a direct voltage of an electrostatic latent image on the photosensitive drum 20 is maintained constant, and a peak-to-peak voltage Vpp and a duty ratio of an alternating voltage of the developing bias are fixed, the frequency of the alternating voltage is changed. As a result, the image density of a toner image detected by the density sensor 100 tends to be different depending on the toner charge amount on the developing roller 231 (FIG. 4). That is, as illustrated in FIG. 4, when the toner charge amount is 27.5 μc/g, the image density decreases as a frequency f decreases. On the other hand, when the toner charge amount is 34.0 μc/g and 37.7 μc/g, the image density increases as the frequency f decreases. Moreover, the slope of each graph in FIG. 4 increases as the toner charge amount decreases. Referring to FIG. 5, the relationship between the slopes of three graphs in FIG. 4 and the toner charge amount is distributed on a straight line (approximate straight line). If the information illustrated in FIG. 5 is previously stored in the storage 983 and the slope of each line in FIG. 4 is derived in the charge amount measurement mode to be described later, it is possible to measure (estimate) the toner charge amount in that case.

<Effects of Estimation of Toner Charge Amount>

In the present embodiment, it is not necessary to provide a surface potential sensor that measures the surface potential of the photosensitive drum 20 for the purpose of estimating a toner charge amount. In addition, it is not necessary to measure a current flowing into the developing roller 231 according to a developing bias for the purpose of estimating the toner charge amount. Consequently, it is possible to stably estimate the toner charge amount without being affected by dirt on the surface potential sensor and a change in current flowing into the developing roller 231 due to a change in carrier resistance. As a result, when the density of an image to be printed by the image forming apparatus 10 decreases, it is possible to easily select a method of increasing the image density by increasing the toner density of the development device 23 to decrease the toner charge amount or a method of increasing the image density by increasing a development potential difference (Vdc−VL) at the development nip NP.

In general, causes for a decrease in image density in the image forming apparatus 10 include "decrease in development potential difference", "decrease in conveying amount of developer passing through regulating blade 234", "increase in carrier resistance", "increase in toner charge amount", and the like. For the decrease in image density caused by factors other than the increase in toner charge amount, if the toner density is increased to decrease the toner charge amount, a new problem such as toner scattering may occur. For the decrease in image density caused by the increase in toner charge amount, the toner charge amount is desirably decreased by increasing the toner density. For the decrease in image density caused by other factors, it is preferable to increase a developing electric field (developing bias). Moreover, as a transfer current applied to the secondary transfer roller 145 can be optimized by recognizing the toner charge amount, it is possible to further stabilize the entire system of the image forming apparatus 10.

<Relationship Between Frequency and Toner Charge Amount>

The inventors of the present invention assume that a toner charge amount contributes to a change in image density when the frequency of an alternating voltage of a developing bias changes as follows.

(1) When Toner Charge Amount is Low

When the toner charge amount is low, electrostatic adhesion force acting between toner and carrier is also low, and thus the toner is easily separated from the carrier. However, as the frequency of the alternating voltage of the developing bias decreases, the number of reciprocal movements of toner at the development nip NP decreases. The image density thus decreases accordingly. When the frequency decreases, the distance of the reciprocal movement of toner per period of the alternating voltage increases. However, when the toner charge amount is low, the movement distance of toner is originally short and thus the decrease in image distance is hardly affected. As described above, when the toner charge amount is low, as the frequency of the alternating voltage of the developing bias decreases, the image density also decreases.

(2) When Toner Charge Amount is High

As described above, when the frequency of the alternating voltage of the developing bias decreases, the number of reciprocal movements of toner at the development nip NP also decreases. However, when the toner charge amount is high, toner is originally difficult to be separated from carrier, and thus the decrease in the number of reciprocal movements is hardly affected. On the other hand, when the frequency decreases, the distance of the reciprocal movement of toner per period of the alternating voltage increases and thus the image density increases according to high toner charge amount. As described above, when the toner charge amount is high, the image density increases as the frequency of the alternating voltage of the developing bias decreases.

<Toner Charge Amount Measurement Mode>

Figure 6:
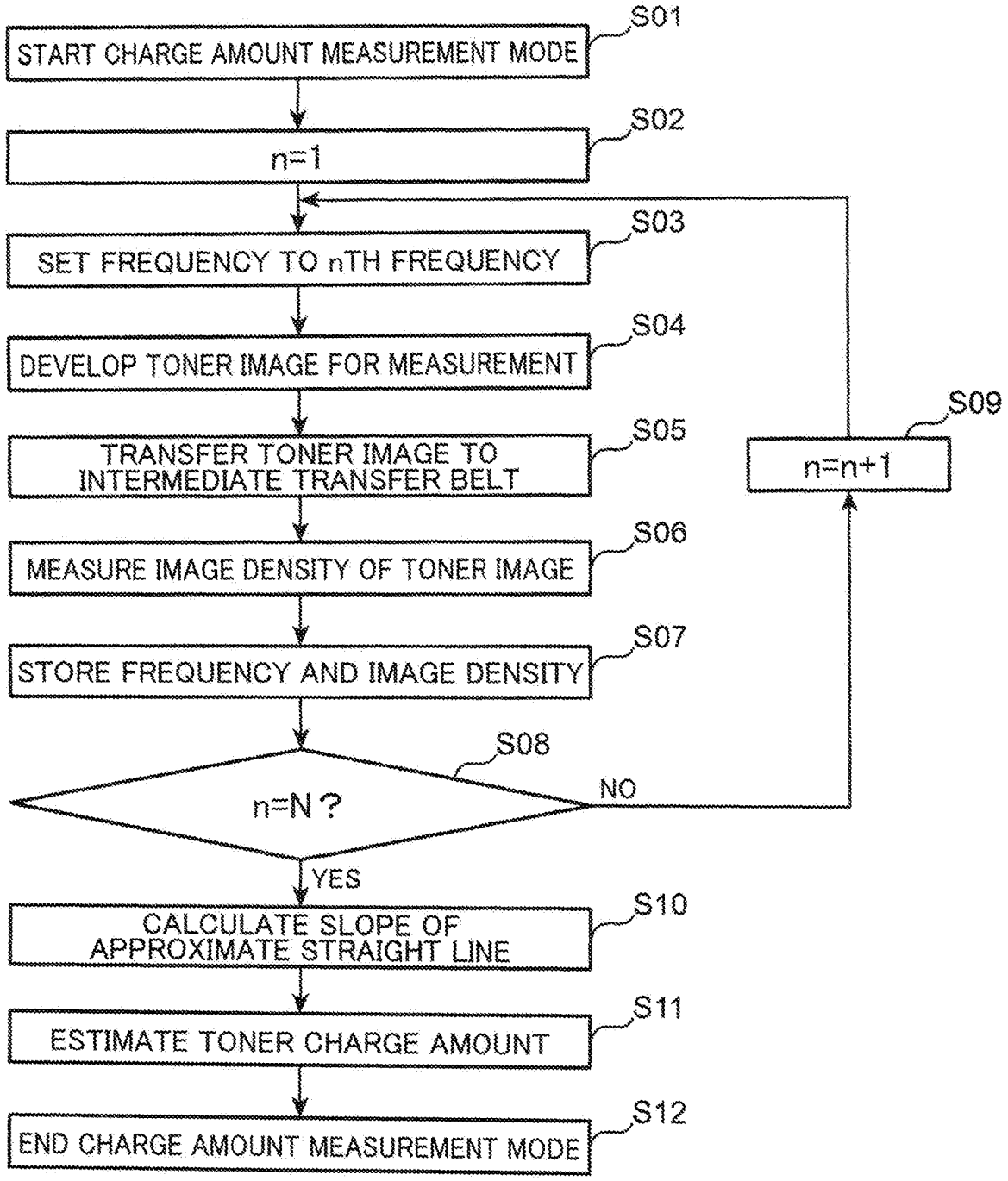
FIG. 6 is a flowchart of a first charge amount acquisition operation performed by the image forming apparatus according to an embodiment of the present invention.
Figure 7:
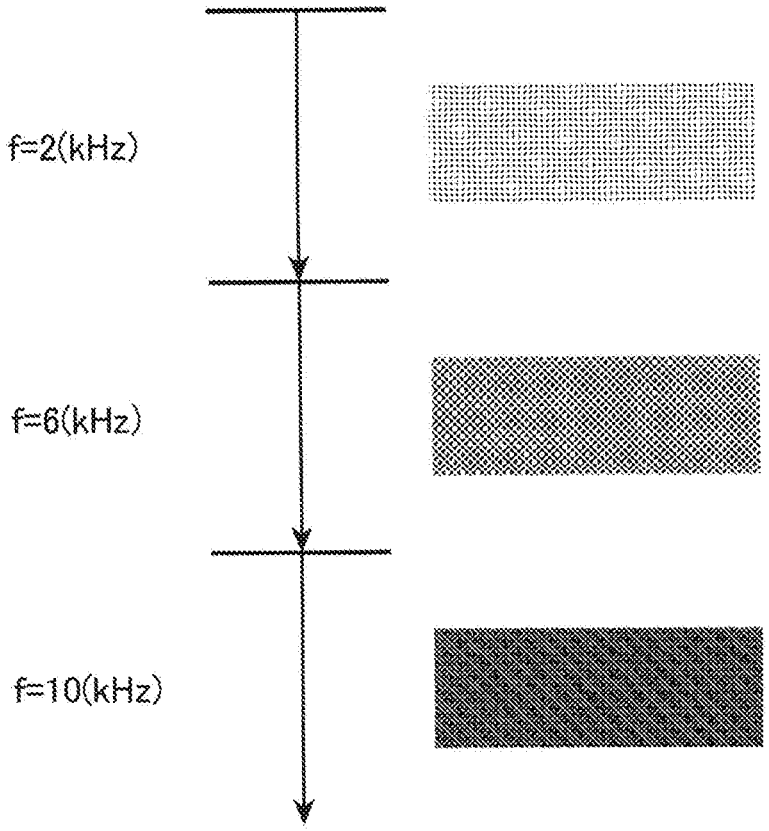
FIG. 7 is a schematic view of a toner image for measurement formed on an image carrier in the first charge amount acquisition operation performed by the image forming apparatus according to an embodiment of the present invention.

FIG. 6 is a flowchart of a charge amount measurement mode performed by the image forming apparatus 10 according to the present embodiment. FIG. 7 is a schematic view of a toner image for measurement formed on the photosensitive drum 20 in the charge amount measurement mode. In the present embodiment, the mode controller 984 performs the charge amount measurement mode during a non-image forming operation in which an image forming operation of forming a toner image on a sheet P is not performed.

Referring to FIG. 6, when a charge amount measurement mode starts (step S01), the mode controller 984 sets a variable n for changing the frequency of a developing bias alternating voltage to n=1 (step S02). When the charge amount measurement mode starts in step S01, the mode controller 984 stores the toner density of a developer in the development device 23 detected by the toner sensor 990 in the storage 983 at a predetermined time interval. The mode controller 984 controls the drive controller 981 and the bias controller 982 to rotate the developing roller 231 one or more times while applying a previously set reference developing bias to the developing roller 231. Thereafter, the mode controller 984 sets the frequency of the alternating voltage of the developing bias to a first frequency (n=1) (step S03). The reference developing bias is set so that the charge amount measurement mode is not affected by the history of the previous image forming process. A bias used for print (image formation) is normally used for the condition for the reference developing bias. If only a direct voltage is used as the reference developing bias, the history is not cleared completely. Consequently, the direct voltage and the alternating voltage are desirably used in a superimposed manner.

Next, a previously set toner image for measurement is developed at a developing bias in which the frequency of the alternating voltage is set to the first frequency (step S04), and the toner image is then transferred from the photosensitive drum 20 to the intermediate transfer belt 141 (step S05). The image density of the toner image for measurement is measured by the density sensor 100 (step S06), and the acquired image density is stored in the storage 983 together with the first frequency (step S07).

Next, the mode controller 984 determines whether the variable n for frequency reaches a specified number of times N which has been previously set (step S08). When n≠N (NO in step S08), n is counted up (n=n+1, step S09) and the processes in steps S03 to S07 are repeated. To improve the accuracy of charge amount measurement, the specified number of times N is desirably set to N=2 or more and more desirably to 3≤N. On the other hand, when n=N (YES in step S08), the mode controller 984 calculates the slope of an approximate straight line illustrated in FIG. 4 based on the information stored in the storage 983 (step S10). The mode controller 984 then estimates the toner charge amount from the slope based on the graph (reference information) illustrated in FIG. 5, which is stored in the storage 983 (step S11), and the charge amount measurement mode ends (step S12).

FIG. 7 illustrates an example in which the image density of a toner image for measurement is increased by increasing the frequency f when the specified number of times N=3. In this case, the toner charge amount is relatively low such as 27.5 μc/g in FIG. 4.

When N=2, the image density measured in step S06 is defined as ID1 and ID2. In addition, the first frequency is defined as f1 (kHz) and the second frequency is defined as f2 (kHz) (f2<f1). In this case, the slope a of each straight line illustrated in FIG. 4 is calculated by Equation 1.

$$\text{slope } a = (ID1 - ID2)/(f1 - f2) \quad \text{(Equation 1)}$$

The slope a varies depending on the toner charge amount. When the toner charge amount is low, the slope a is "positive (+)". When the toner charge amount is low, the slope a is "negative (−)". When the toner charge amount is measured under the condition of 3≤N, the slope of a primary approximate straight line obtained by the least squares method may be used. The reference information illustrated in FIG. 5 is represented by Equation 2.

$$Q/M=A\times\text{slope of straight line}+B \quad \text{(Equation 2)}$$

Here, A and B are values inherent to a developer and previously determined by experiments. Q/M indicates a toner charge amount per unit mass. By substituting the slope a of the approximate straight line calculated by Equation 1 in step S10 for Equation 2, the toner charge amount Q/M is obtained. The mode controller 984 stores the toner charge amount Q/M (=first toner charge amount TV1 to be described later) acquired by the above-described process in the storage 983 together with the toner density TC1 (%) within the development device 23 in the charge amount measurement mode. The toner density TC1 corresponds to the average of toner density values detected by the toner sensor 990 at a predetermined time interval in the charge amount measurement mode.

When the charge amount measurement mode ends (step S12 of FIG. 6), the mode controller 984 determines constants α and β satisfying the following Equation 3 based on the first toner charge amount TV1 (μc/g) and the toner density TC1 (%), and stores these constants in the storage 983. The constants α and β are referred to in a real-time charge amount measurement operation to be described later.

$$1/TV1=\alpha\times TC1+\beta \quad \text{(Equation 3)}$$

When the image forming apparatus 10 is manufactured and shipped, a ratio γ of β to α (=β/α), which is a constant value, is previously stored in the storage 983. When the image forming apparatus 10 is installed at a position where the image forming apparatus 10 is used and the charge amount measurement mode is performed for the first time, α and β are derived from the relationship between the above Equation 3 and γ=β/α. Thereafter, every time the charge amount measurement mode is performed, α and β indicating the latest state of a developer are stored in the storage 983.

The charge amount measurement mode illustrated in FIG. 6 may be performed in the development device 23 for each color illustrated in FIG. 1. In addition, the frequency set in the charge amount measurement mode may be set to an inherent value for each of the development devices 23. In particular, when the desired frequency according to the surrounding temperature and humidity of the image forming apparatus 10 and the number of prints in the image forming apparatus 10 is already known, the frequency set in the charge amount measurement mode may be set to a frequency near the known frequency. Alternatively, by referring to the result of the previous toner charge amount measurement mode, a frequency used for a new measurement mode may be selected. In this case, accuracy of a toner charge amount to be measured is improved.

<Timing of Performing Charge Amount Measurement Mode>

The charge amount measurement mode of the present embodiment starts to be performed automatically or manually. An automatic charge amount measurement mode is performed before or after the calibration of the image forming apparatus 10 (also referred to as setup and image quality adjustment operation).

More desirably, a plurality of density sensors 100 are disposed in a main scanning direction (axial direction of photosensitive drum 20) and a toner image for measurement is formed according to the position of each density sensor 100. That is, when the toner image for measurement is formed so as to correspond to each of axial end portions of the photosensitive drum 20, the toner charge amount can be estimated at each end portion of the development device 23 (developing roller 231). When the difference in toner charge amount between the end portions is larger than a previously set threshold, the charging performance of the development device 23 may be degraded. Consequently, the mode controller 984 is capable of prompting a user to replace the development device 23 or a developer through a display section (not illustrated) in the image forming apparatus 10.

Moreover, it is desirable to perform the charge amount measurement mode when the image forming apparatus 10 is manufactured and then shipped from the factory and when the image forming apparatus 10 is set up at the position where the image forming apparatus 10 is used. Consequently, it is possible to estimate the effect of an idle period on the image forming apparatus 10. That is, the charge amount of a developer tends to be low if the idle period is long, and this tendency usually varies depending on the period or environment the image forming apparatus 10 is left. For this reason, by measuring the toner charge amount at the time of shipment from the factory and setup, the state of the developer degraded due to being left is estimated. When the developer is left for a very long time or in an inferior environment, the difference in toner charge amount between two cases (toner charge amount in shipment from factory and toner charge amount in setup) is detected to be large. In such a case, it is possible to prompt a user to replace the developer at the position where the image forming apparatus 10 is used, as in the above case.

Meanwhile, if the toner charge amount is low in shipment from the factory and in setup, when the difference in toner charge amount between such cases is small, the developer is unlikely to be degraded. Consequently, it is not necessary to replace the developer at the position where the image forming apparatus 10 is used. By simply adjusting the toner density and development condition (developing bias and the like), image quality can be improved. As the toner charge amount measurement mode of the present embodiment is performed after the image forming apparatus 10 is left unused for a predetermined period of time as described above, it is possible to recognize a change in the state of a developer.

As described above, in the charge amount measurement mode of the present embodiment, it is possible to acquire the charge amount of toner accommodated in the development device 23 without using a surface potential sensor that measures the potential of the photosensitive drum 20 and an ammeter that measures a developing current flowing into the developing roller 231. Consequently, it is possible to accurately determine whether the developer in the development device 23 needs to be replaced or whether a developing bias needs to be adjusted.

In particular, the reference information stored in the storage 983 is set so that when the toner charge amount is a first charge amount, the slope of the straight line for reference is negative, when the toner charge amount is a second charge amount less than the first charge amount, the slope of the straight line for reference is positive, and the slope of the straight line for reference increases as the toner charge amount decreases. With such a configuration, the toner charge amount can be accurately acquired from the relationship between the frequency of the alternating voltage of the developing bias and the density of the toner image (developing toner amount) formed on the photosensitive drum 20 (intermediate transfer belt 141).

<Real-Time Charge Amount Measurement Operation>

As described above, in the charge amount measurement mode of the present embodiment, the toner charge amount can be accurately measured. However, to perform such a charge amount measurement mode, a plurality of toner images for measurement need to be formed on the photosensitive drum 20. For this reason, an image forming operation of the image forming apparatus 10 is temporarily suspended. It is thus desired to measure the toner charge amount with predetermined accuracy in real time during the image forming operation. The inventors of the present invention have found a new method of acquiring the toner charge amount in real time during the image forming operation by using measurement results in the charge amount measurement mode described above. "Real time" means that the toner charge amount changing during the image forming operation is detected and acquired during the image forming operation.

Figure 8:
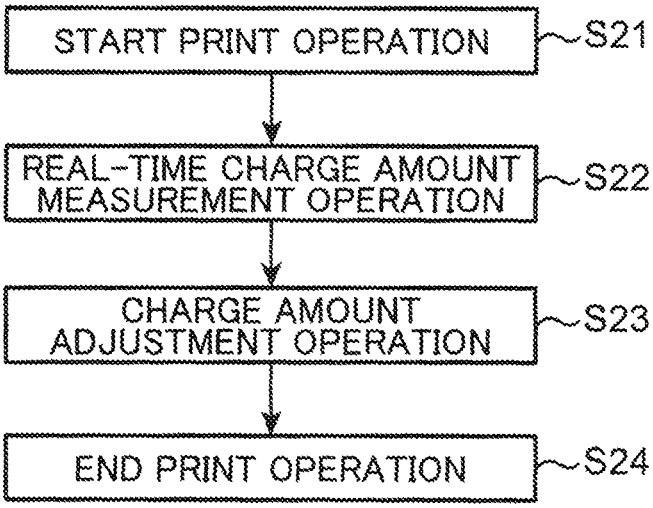
FIG. 8 is a flowchart of a second charge amount acquisition operation and a charge amount adjustment operation according to an embodiment of the present invention.
Figure 9:
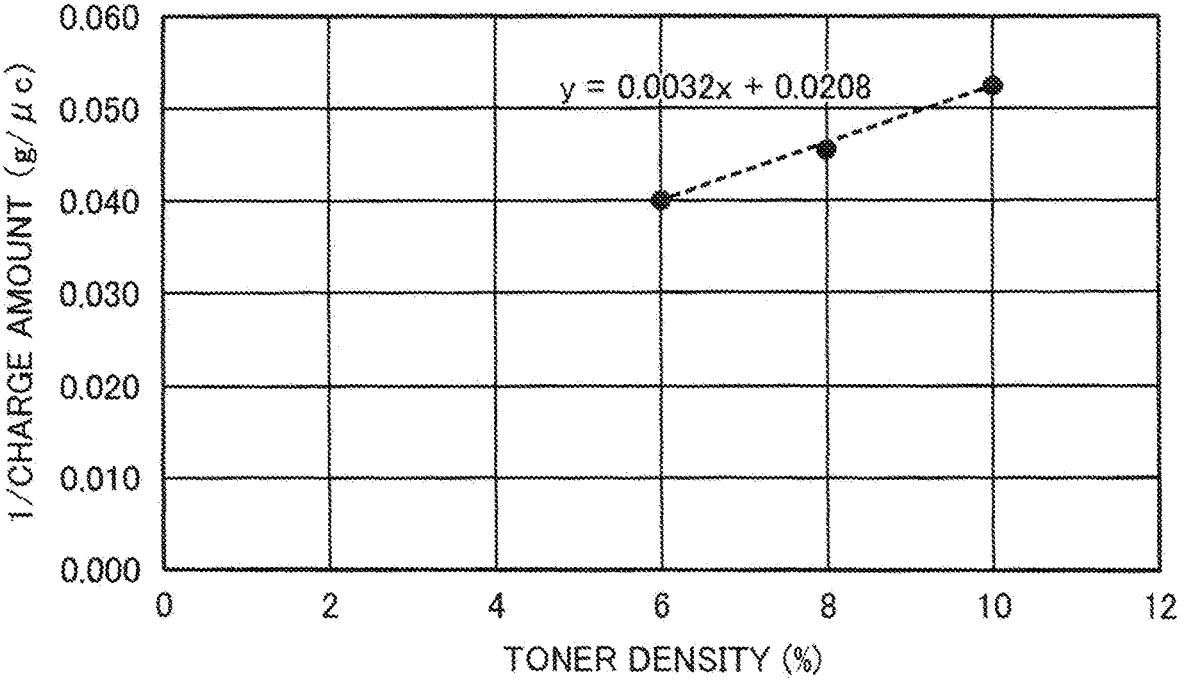
FIG. 9 is a graph illustrating a relationship between toner density and the toner charge amount in the image forming apparatus according to an embodiment of the present invention.

FIG. 8 is a flowchart of a real-time charge amount measurement operation (second charge amount acquisition operation) and a charge amount adjustment operation according to the present embodiment. FIG. 9 is a graph illustrating a relationship between toner density and a toner charge amount in the development device 23 of the image forming apparatus 10 according to the present embodiment.

Referring to FIG. 8, when an image forming operation (print operation) starts in the image forming apparatus 10 (step S21), the mode controller 984 starts a real-time charge amount measurement operation (step S22). The real-time charge amount measurement operation is performed in parallel with the image forming operation, and the toner charge amount (second toner charge amount) is acquired. When step S22 starts, the mode controller 984 refers to the constants α and β after the previous (latest) charge amount measurement mode from the storage 983 to prepare for the following Equation 4.

$$TV2=1/(\alpha\times TC2+\beta) \quad \text{(Equation 4)}$$

The graph illustrated in FIG. 9 is obtained by plotting TC1 and TV1 acquired in the past charge amount measurement mode. That is, each point of the graph illustrated in FIG. 9 corresponds to data of one charge amount measurement mode. Assuming that TC1 and TV1 in Equation 3 respectively indicate a variable TC (toner density) and a variable TV (charge amount), regression of the graph illustrated in FIG. 9 is performed using a straight line represented by the following Equation 5.

$$1/TV=\alpha\times TC+\beta \quad \text{(Equation 5)}$$

An X-intercept of the graph illustrated in FIG. 9 (y=1/charge amount=0) corresponds to β/α. The mode controller 984 substitutes the toner density TC2 sequentially output from the toner sensor 990 during the image forming operation for Equation 4 to acquire the toner charge amount (second toner charge amount).

Next, the mode controller 984 performs the charge amount adjustment operation based on the acquired toner charge amount (step S23).

<Charge Amount Adjustment Operation>

Figure 10:
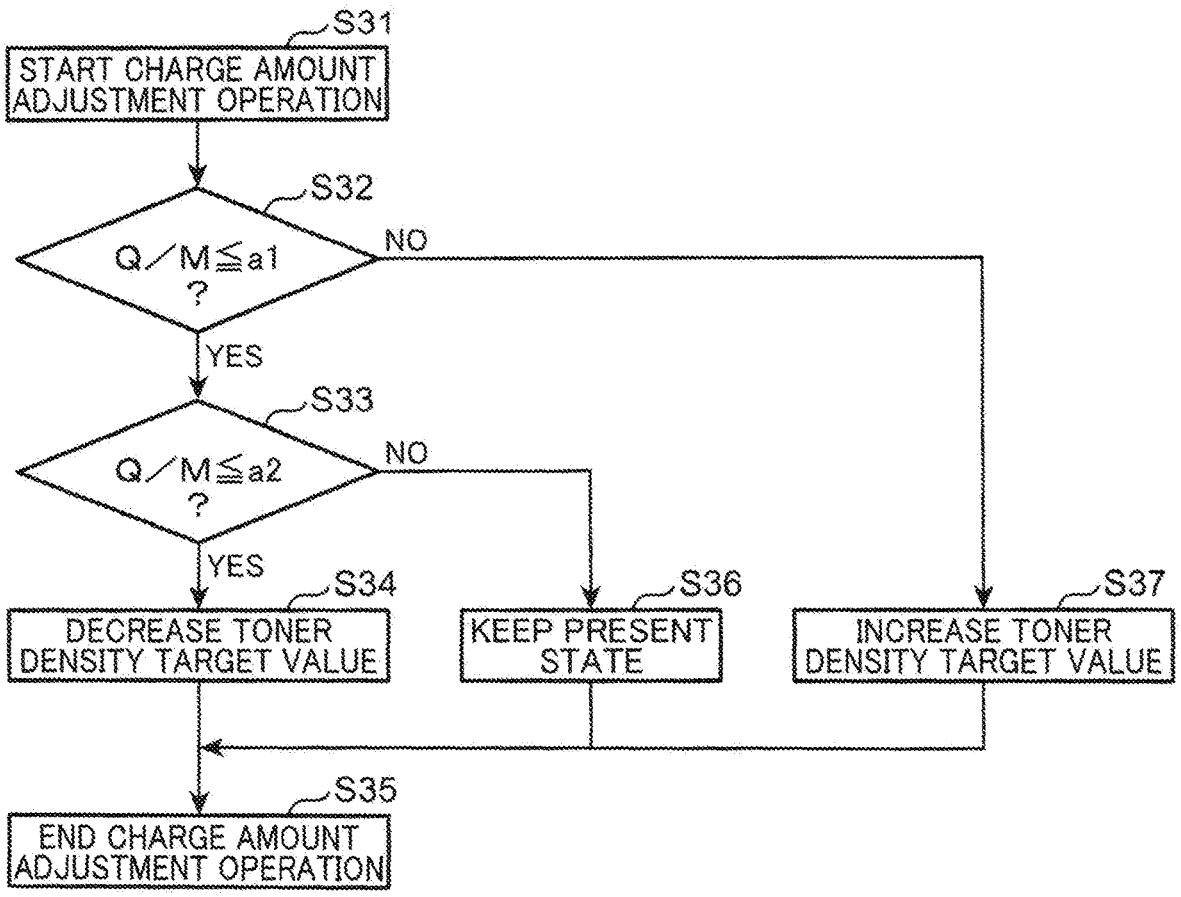
FIG. 10 is a flowchart of the charge amount adjustment operation performed by the image forming apparatus according to an embodiment of the present invention.

FIG. 10 is a flowchart of a charge amount adjustment operation performed by the image forming apparatus 10 according to the present embodiment. When step S31 of FIG. 10 (step S23 of FIG. 8) starts, it is determined whether the toner charge amount TV2 (=Q/M) acquired in step S22 of FIG. 8 is less than or equal to a previously set threshold a1 (step S32). When Q/M≤a1 (YES in step S32), the mode controller 984 further determines whether the charge amount Q/M is less than or equal to a previously set threshold a2 (step S33). Note that a1 and a2 are previously set so as to satisfy a2≤a1 and stored in the storage 983.

When Q/M≤a2 in step S33 (YES in step S33), the mode controller 984 decreases a toner density target value adjusted by the replenishment controller 985 (step S34). The replenishment controller 985 thus suspends the replenishment of toner from the toner replenishing section 15 to the development device 23 for a predetermined period even if the toner is consumed in the image forming operation of the image forming apparatus 10. As a result, frictional charging of toner already accommodated in the development device 23 is facilitated and thus the charge amount of toner in the development device 23 can be stably increased. It is thus possible to form an excellent image in the image forming apparatus 10. After step S34, the mode controller 984 ends the charge amount adjustment operation (step S35). The mode controller 984 may perform again steps S32 and S33 after step S34 to check whether the toner charge amount returns to an appropriate range.

Meanwhile, when Q/M>a2 in step S33 (NO in step S33), the mode controller 984 determines that the charge amount of toner in the development device 23 is within the appropriate range and ends the charge amount adjustment operation (step S35) while keeping the present state (step S36).

Moreover, when Q/M>a1 in step S32 (NO in step S32), the mode controller 984 determines that the toner charge amount is high and increases the toner density target value controlled by the replenishment controller 985 as the operation of decreasing the charge amount (step S37). Consequently, the replenishment controller 985 performs the toner replenishing operation of replenishing toner from the toner replenishing section 15 to the development device 23. As the amount of toner in the development device 23 is increased, the toner charge amount can be stably decreased. As a result, it is possible to form an excellent image in the image forming apparatus 10. After step S37, the mode controller 984 ends the charge amount adjustment mode (step S35). The mode controller 984 may perform again steps S32 and S33 after step S37 to check whether the toner charge amount returns to the appropriate range.

As the charge amount adjustment operation illustrated in FIG. 10 is performed, the charge amount of toner in the development device 23 can be accurately adjusted according to the acquired toner charge amount.

As described above, according to the present embodiment, the mode controller 984 performs the charge amount measurement mode (first charge amount acquisition operation) that can be performed during a non-image forming operation and the real-time charge amount measurement operation (second charge amount acquisition operation) that can be performed at least during an image forming operation. In the first charge amount acquisition operation, the first toner charge amount that is the charge amount of toner included in a toner image for measurement formed on the photosensitive drum 20 is acquired based on density of a plurality of toner images for measurement detected by the density sensor 100 or based on, in addition to the density of the plurality of toner images for measurement, a direct component of a developing current flowing between the developing roller 231 and the developing bias application section 971 at the time of forming the toner images for measurement. By referring to values varying depending on the density of a toner image for measurement in the acquisition operation, it is possible to accurately acquire the first toner charge amount. Meanwhile, in the second charge amount acquisition operation, the second toner charge amount is acquired by using toner density detected by the toner sensor 990 during the image forming operation. It is thus possible to acquire the toner charge amount without affecting the image forming operation. In addition, the relationship between the first toner charge amount acquired in the first charge amount acquisition operation and the toner density is used in the second charge amount acquisition operation. Consequently, the charge amount of toner in a developer accommodated in the development device 23 is acquired easily and accurately. That is, it is possible to acquire the toner charge amount during the image forming operation by effectively using information of the first charge amount acquisition operation acquired by temporarily suspending the image forming operation. Consequently, parameters including a developing bias are changed according to the acquired toner charge amount during the image forming operation to stabilize image density. Moreover, the toner charge amount during the image forming operation can be stabilized. By stabilizing the toner charge amount as described above, an operation of transferring toner to a sheet P is also stabilized and the entire system of the image forming apparatus 10 is further stabilized. As a result, quality of an image formed on the sheet P (image density) is kept stable. That is, in the present embodiment, it is possible to provide the image forming apparatus 10 that includes the development device 23 employing a two-component developing method and is capable of measuring the toner charge amount during the image forming operation.

In the present embodiment, the toner charge amount (second toner charge amount) during the image forming operation can be easily acquired based on the relational expressions established between the toner density and the toner charge amount in the charge amount measurement mode.

In addition, according to the present embodiment, the mode controller 984 adjusts the charge amount of toner in the development device 23 based on the second toner charge amount acquired in the real-time charge amount measurement operation, thus stably acquiring an image in the image forming operation. A charge amount adjustment operation similar to the charge amount adjustment operation described above may be performed based on the first toner charge amount acquired in the charge amount measurement mode. This is also applicable to the following description.

According to the present embodiment, when the acquired first or second toner charge amount is high, the charge amount of toner in each development device 23 can be decreased by replenishing toner replenished from the toner replenishing section 15. As a result, it is possible to stably acquire an image in the image forming operation.

According to the present embodiment, when the acquired first or second toner charge amount is low, the target toner density range (target toner density) is reduced to suspend the replenishment of toner from the toner replenishing section 15, so that the charge amount of toner in each development device 23 can be increased. As a result, it is possible to stably acquire an image in the image forming operation.

Example

The embodiment of the present invention will be described in further detail by using an example. It should be noted that the present invention is not limited to the following example.

Conditions of a comparative experiment conducted are as follows.

<Common Experimental Conditions> print speed: 55 sheets/min.

photosensitive drum 20: amorphous silicon photosensitive body (α-Si)

developing roller 231: outer diameter of 20 mm, knurling is performed on surface, and 80 columns of recesses (trenches) are formed along circumferential direction regulating blade 234: made of SUS430, magnetic, thickness of 1.5 mm conveyance amount of developer after passing regulating blade 234: 250 g/$m^2$ peripheral speed of developing roller 231 relative to photosensitive drum 20: 1.8 (trail direction at opposing position)

distance between photosensitive drum 20 and developing roller 231: 0.30 mm potential V0 of white portion (background portion) of photosensitive drum 20: +270V potential VL of image portion of photosensitive drum 20: +20V developing bias of developing roller 231: frequency=6.0 kHz, Duty=50%, Vpp=rectangular wave of alternating voltage of 1000V, and Vdc (direct voltage)=200V toner: positively charged magnetic toner, volume average particle diameter of 6.8 μm, and toner density of 8% carrier: volume average particle diameter of 35 μm and ferrite resin-coated carrier <Developer>

It is found that grinded toner and core shell toner both achieved similar effects. It was found that the toner density in the range of 3% to 12% has achieved similar effects. Since a magnetic bush is finer, the movement of toner due to an alternating magnetic field occurs more apparently. Consequently, the volume average particle diameter of carrier is preferably 45 μm or less and more preferably 30 μm or more and 40 μm or less. A resin carrier whose true specific gravity is less than that of ferrite carrier is more preferably used. In the experiments, the measurement (actual measurement) of the toner charge amount was conducted by using blow-off compact charge amount measurement device MODEL212HS manufactured by TREK, Inc.

<Carrier>

Carrier was obtained by coating silicon or fluorine on a ferrite core having a volume average particle diameter of 35 μm. Specifically, the carrier was prepared as follows. For 1000 parts by weight of carrier core EF-35 (manufactured by Powdertech Co., Ltd.), 20 parts by weight of silicon resin KR-271 (manufactured by Shin-Etsu Chemical Co., Ltd.) was dissolved into 200 parts by weight of toluene to prepare a coating solution. The coating solution was sprayed to the carrier core by a fluidized layer coating device and a thermal process was performed at 200° C. for 60 minutes, so that the carrier was obtained. A conductive agent and a charge control agent were mixed and dispersed in the coating solution in the range of 0 to 20 parts for 100 parts of coat resin for the purpose of performing resistance adjustment and charging adjustment.

Under the conditions described above, the toner charge amount was adjusted by changing the amount of a toner external additive and a print operation was performed. FIGS. 4 and 5 illustrate the experiment results. In FIG. 4, the image density of a toner image on the intermediate transfer belt 141 is measured by the density sensor 100. The density of the toner image is then represented as I.D of a toner fixed image by using a correlation curve of the image density (sensor output) of a toner image previously acquired and the image density of a toner fixed image formed on a print sheet (sheet).

FIG. 5 illustrates the relationship between the toner charge amount and the slope of each of the straight lines (approximate straight lines) illustrated in FIG. 4. Equation 6 (shown below) for the approximate straight line illustrated in FIG. 5 is previously stored in the storage 983. The toner charge amount can be estimated by Equation 6.

$$\text{toner charge amount } Q/M\ (\mu c/g) = -442.32 \times \text{slope} + 29.87 \quad \text{(Equation 6)}$$

Slope of Equation 6=Δ image density/Δ frequency (see slope of graph illustrated in FIG. 4)

While the embodiment of the present invention has been described above, the present invention is not limited to the embodiment, and the following modifications are possible, for example.

(1) In the embodiment described above, knurling is performed on the surface of the developing roller 231. However, recesses (dimples) may be formed on the surface of the developing roller 231 or blasting may be performed on the surface of the developing roller 231.

(2) In the embodiment described above, the ratio $\gamma$ of $\beta$ to $\alpha$ ($=\beta/\alpha$) in Equations 3 and 4 is fixed and previously stored in the storage 983. However, the present invention is not limited thereto. The mode controller 984 may include a correction mode of correcting the X-intercept ($\gamma=\beta/\alpha$) of the graph illustrated in FIG. 9. In this case, the accuracy of the approximate straight line illustrated in FIG. 9 can be improved. In such a case, the toner replenishing section 15 may be controlled in the correction mode to forcibly perform toner replenishment. Alternatively, toner may be forcibly consumed to decrease the toner density, and in such a state, the charge amount measurement mode illustrated in FIG. 6 may be performed. With such a correction mode, it is possible to acquire data indicating the relationship between the toner density and the toner charge amount for different toner density conditions. As a result, Equation 3 based on the latest state of a developer can be obtained and at the same time, the X-intercept of the graph illustrated in FIG. 5 can be obtained. The obtained X-intercept is referred to by the mode controller 984 until the next correction mode of correcting the X-intercept is performed.

(3) When the image forming apparatus 10 includes a plurality of development devices 23 as illustrated in FIG. 1, the charge amount measurement mode of the embodiment described above may be performed in one or two development devices 23, and the remaining development devices 23 may use the results.

Figure 11:
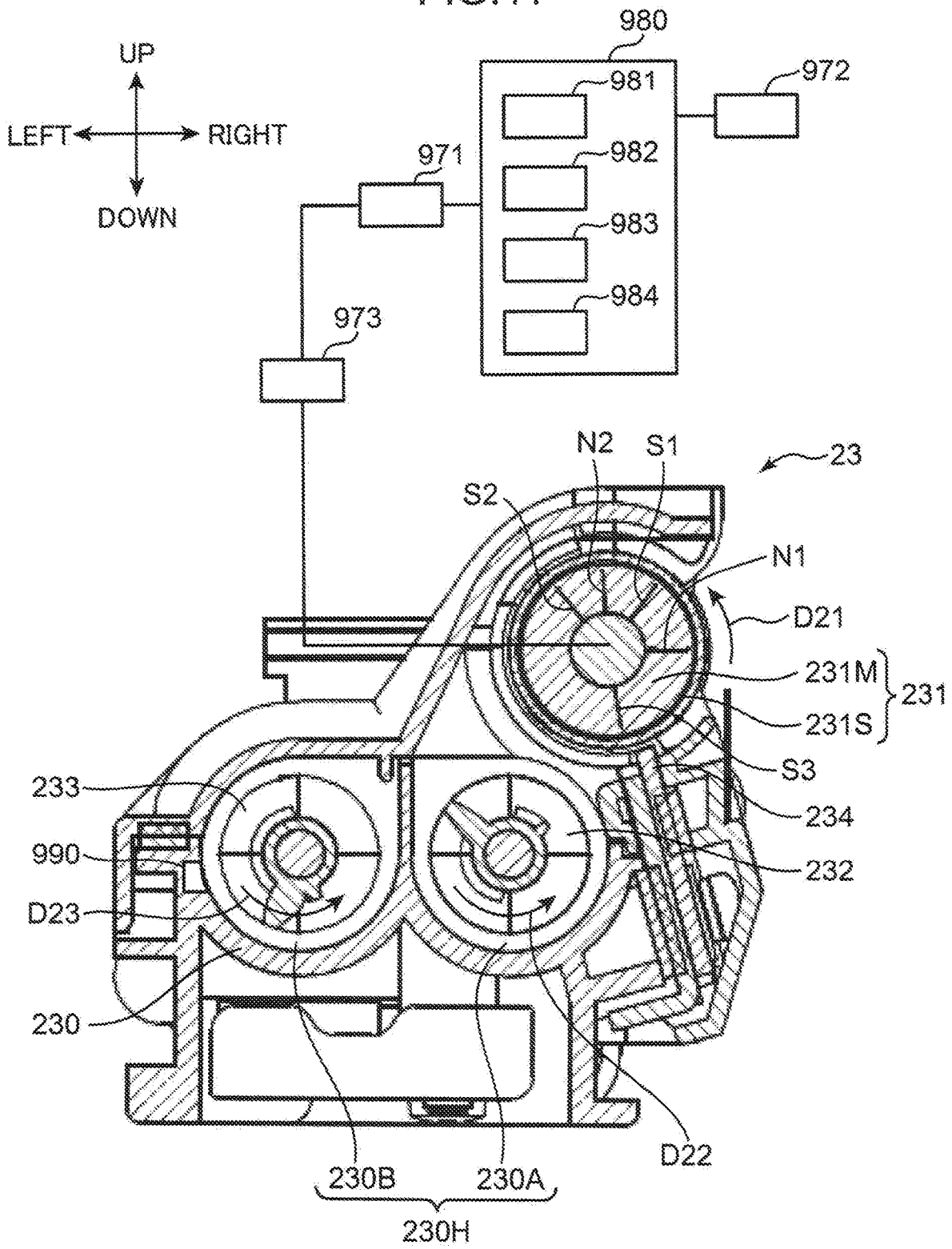
FIG. 11 illustrates a cross-sectional view of a development device and a block diagram of an electric configuration of a controller according to a modified embodiment of the present invention.
Figure 12:
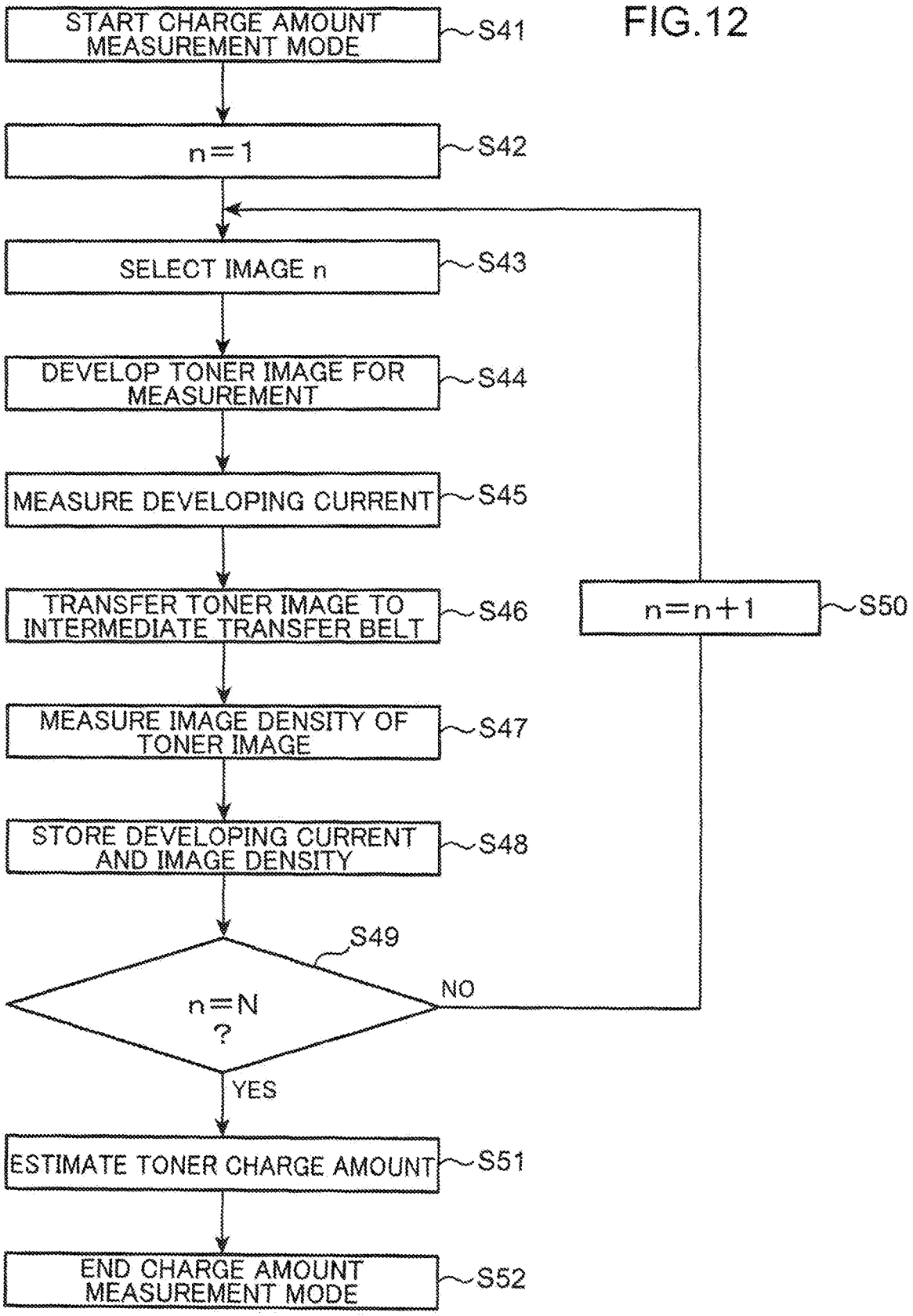
FIG. 12 is a flowchart of a first charge amount acquisition operation performed by an image forming apparatus according to the modified embodiment of the present invention.

(4) In the embodiment described above, in the charge amount measurement mode, the mode controller 984 acquires the charge amount of toner included in a toner image for measurement formed on the photosensitive drum 20 from the slope of a straight line for measurement and reference information stored in the storage 983. However, the present invention is not limited thereto. FIG. 11 illustrates a cross-sectional view of the development device 23 of a modified embodiment of the present invention and a block diagram of an electric configuration of the controller 980. FIG. 12 is a flowchart of a charge amount measurement mode performed by the image forming apparatus 10 according to the present modified embodiment.

In the present modified embodiment, the image forming apparatus 10 further includes an ammeter 973.

The ammeter 973 detects a direct current flowing between the developing roller 231 and the developing bias application section 971.

In the charge amount measurement mode, the mode controller 984 forms a plurality of toner images for measurement on the photosensitive drum 20 while changing the frequency of an alternating voltage of a developing bias and maintaining constant a potential difference in direct voltage between the developing roller 231 and the photosensitive drum 20. The mode controller 984 then acquires the charge amount of toner included in the toner image for measurement formed on the photosensitive drum 20 based on the ratio of the difference in the direct component of a developing current flowing between the developing roller 231 and the developing bias application section 971 at the time of forming the plurality of toner images for measurement to the difference in the density of the plurality of toner images for measurement detected by the density sensor 100.

Referring to FIG. 12, when starting a charge amount measurement mode (step S41), the mode controller 984 sets a variable n for forming a plurality of toner images for measurement to n=1 (step S42). The mode controller 984 then selects an image 1 corresponding to n=1 previously stored in the storage 983 (step S43). The storage 983 stores image information of an electrostatic latent image for forming an image n and information about the frequency of an alternating voltage of a developing bias. Other parameters for an image forming operation are set to the same values as those of the previous image forming operation. Next, the mode controller 984 controls the exposure device 22 (FIG. 1), the drive controller 981, and the bias controller 982 to rotate the developing roller 231 one or more times with a developing bias for forming the image 1 being applied to the developing roller 231, so that an electrostatic latent image of a toner image for measurement corresponding to the image 1 is formed on the photosensitive drum 20. As the photosensitive drum 20 rotates, the toner image for measurement passes through the development nip NP where the photosensitive drum 20 opposes the developing roller 231, toner is supplied to the electrostatic latent image, and the toner image for measurement is thus developed (step S44). In the development operation, the ammeter 973 measures a developing current (direct current) (step S45).

The toner image is then transferred from the photosensitive drum 20 to the intermediate transfer belt 141 (step S46). The density sensor 100 measures the image density of the toner image for measurement (step S47), and the acquired image density and the developing current measured in step S45 are stored in the storage 983 (step S48).

Next, the mode controller 984 determines whether the variable n for forming a plurality of toner images for measurement reaches the specified number of times N which has been previously set (step S49). When n≠N (NO in step S49), n is counted up by one (n=n+1, step S50) and the processes in steps S43 to S49 are repeated. To improve the accuracy of charge amount measurement, the specified number of times N is desirably set to N=2 or more and more desirably to 3≤N. On the other hand, when n=N (YES in step S49), the mode controller 984 estimates the toner charge amount (step S51) and the charge amount measurement mode ends (step S52).

For example, when N=2, the developing current (direct current) measured in step S45 for n=1, 2 is defined as I1 and I2, respectively. In addition, the image density measured in step S47 for n=1, 2 is defined as ID1 and ID2, respectively.

In this case, the toner charge amount in step S41 corresponds to the slope a obtained by the following Equation 7.

$$\text{slope } a=(I1-I2)/(ID1-ID2) \quad \text{(Equation 7)}$$

The slope a corresponds to the slope of a straight line passing two points when data for n=1, 2 (ID, 1) is plotted on a graph with a horizontal axis of image density ID and a vertical axis of developing current 1. When the toner charge amount is measured on the condition that N=3 or more, the slope a of a primary approximate straight line calculated by the least squares method is used as the toner charge amount.

According to other modified embodiments, the parameter changed when a plurality of toner images for measurement are formed may be the coverage rate of the electrostatic latent image formed by the exposure device 22 instead of the frequency of the alternating voltage of the developing bias.

That is, in the present modified embodiment, the mode controller 984 forms a plurality of toner images for measurement on the photosensitive drum 20 while changing the coverage rate per unit area by controlling the exposure device 22 and maintaining constant a potential difference in direct voltage between the developing roller 231 and the photosensitive drum 20. The mode controller 984 then acquires the charge amount of toner included in the toner image for measurement formed on the photosensitive drum 20 based on the ratio of the difference in the direct component of a developing current flowing between the developing roller 231 and the developing bias application section 971 at the time of forming the plurality of toner images for measurement to the difference in the density of the plurality of toner images for measurement detected by the density sensor 100. In this case, the toner charge amount is acquired based on Equation 7 as in the modified embodiment described above.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

an image carrier that is rotated to form an electrostatic latent image on a surface and carries a toner image obtained by visualizing the electrostatic latent image;

a charging device that charges the image carrier to a predetermined charging potential;

an exposure device that is disposed on a downstream side of the charging device in a rotating direction of the image carrier and exposes the surface of the image carrier charged to the predetermined charging potential with light according to predetermined image information to form the electrostatic latent image;

a development device that is disposed to oppose the image carrier at a predetermined development nip disposed on a downstream side of the exposure device in the rotating direction and that includes a developing roller that is rotated to carry a developer formed of toner and carrier on a circumferential surface and supplies toner to the image carrier to form the toner image;

a transfer section that transfers the toner image carried on the image carrier to a sheet;

a developing bias application section that is capable of applying a developing bias having an alternating voltage superimposed on a direct voltage to the developing roller;

an image density detector that detects density of the toner image;

a toner density detector that detects toner density that is density of the toner in the developer in the development device; and a charge amount acquisition section that is capable of performing a first charge amount acquisition operation and a second charge amount acquisition operation each of which acquires a toner charge amount; wherein the charge amount acquisition section performs the first charge amount acquisition operation in which during a non-image forming operation in which an image forming operation of forming the toner image on the sheet is not performed, a plurality of toner images for measurement with different toner developing amounts are formed on the image carrier, and based on density of the plurality of toner images for measurement detected by the image density detector or based on a direct component of a developing current flowing between the developing roller and the developing bias application section at the time of forming the plurality of toner images for measurement in addition to the density of the plurality of toner images for measurement, the charge amount acquisition section acquires a first toner charge amount that is a charge amount of toner included in the toner image for measurement formed on the image carrier, and the second charge amount acquisition operation in which at least during the image forming operation, based on the toner density detected by the toner density detector and a relationship between the first toner charge amount acquired in the first charge amount acquisition operation and the toner density detected by the toner density detector in the first charge amount acquisition operation, the charge amount acquisition section acquires a second toner charge amount that is a charge amount of the toner in the developer in the development device.

2. The image forming apparatus according to claim 1, wherein assuming that the first toner charge amount is denoted by TV1 (μc/g), the toner density detected by the toner density detector in the first charge amount acquisition operation is denoted by TC1 (%), the second toner charge amount is denoted by TV2 (μc/g), and the toner density detected by the toner density detector in the second charge amount acquisition operation is denoted by TC2 (%), the charge amount acquisition section determines constants α and β satisfying $1/TV1=\alpha\times TC1+\beta$ and acquires the second toner charge amount based on a relationship between the determined α and β and the detected toner density TC2, and $TV2=1/(\alpha\times TC2+\beta)$.

3. The image forming apparatus according to claim 1 further comprising:

a storage that previously stores reference information for each value of the toner charge amount, the reference information being about a slope of a straight line for reference indicating a relationship between a change in density of the toner image and a change in frequency when the frequency of the alternating voltage of the developing bias changes while a potential difference in direct voltage between the developing roller and the image carrier is maintained constant, wherein in the first charge amount acquisition operation, the charge amount acquisition section forms the plurality of toner images for measurement on the image carrier while changing the frequency of the alternating voltage of the developing bias and maintaining constant the potential difference in direct voltage between the developing roller and the image carrier, acquires a slope of a straight line for measurement indicating a relationship between a change in density of the toner image for measurement and the change in frequency from the change in frequency and a detection result of the density of the toner image for measurement by the image density detector, and acquires the first toner charge amount from the acquired slope of the straight line for measurement and the reference information in the storage.

4. The image forming apparatus according to claim 3, wherein the reference information stored in the storage is set to have a negative slope of the straight line for reference when the toner charge amount is a first charge amount, and is set to have a positive slope of the straight line for reference when the toner charge amount is a second charge amount less than the first charge amount, and the slope of the straight line for reference increases as the toner charge amount decreases.

5. The image forming apparatus according to claim 1, wherein in the first charge amount acquisition operation, the charge amount acquisition section forms the toner images for measurement on the image carrier while changing a frequency of the alternating voltage of the developing bias and maintaining constant a potential difference in direct voltage between the developing roller and the image carrier, and acquires the first toner charge amount based on a ratio of a difference in a direct component of the developing current flowing between the developing roller and the developing bias application section at the time of forming the plurality of toner images for measurement to a difference in density of the plurality of toner images for measurement detected by the image density detector.

6. The image forming apparatus according to claim 1, wherein in the first charge amount acquisition operation, the charge amount acquisition section forms the plurality of toner images for measurement on the image carrier while changing a coverage rate per unit area by controlling the exposure device and maintaining constant a potential difference in direct voltage between the developing roller and the image carrier, and acquires the first toner charge amount based on a ratio of a difference in a direct component of the developing current flowing between the developing roller and the developing bias application section at the time of forming the plurality of toner images for measurement to a difference in density of the plurality of toner images for measurement detected by the image density detector.

7. The image forming apparatus according to claim 1, further comprising:

a charge amount adjustment section that adjusts the toner charge amount based on the first toner charge amount or the second toner charge amount.

8. The image forming apparatus according to claim 7, further comprising:

a toner replenishing section that accommodates replenishing toner to be replenished to the development device;

when the first toner charge amount or the second toner charge amount is higher than a previously set threshold, the charge amount adjustment section replenishes the replenishing toner from the toner replenishing section to the development device to increase the density of toner in the developer, thus adjusting the toner charge amount.

9. The image forming apparatus according to claim 8, further comprising:

a replenishment controller that controls a replenishing operation of the replenishing toner by the toner replenishing section so as to cause the toner density detected by the toner density detector to be included in a previously set target toner density range:

when the first toner charge amount or the second toner charge amount is lower than the threshold, the charge amount adjustment section changes the target toner density range so as to reduce the target toner density range.

* * * * *